US009597254B1

(12) United States Patent
Bhatt

(10) Patent No.: US 9,597,254 B1
(45) Date of Patent: Mar. 21, 2017

(54) DEVICES AND METHODS FOR MANIPULATING SOFT TISSUE

(71) Applicant: Mayank Ashish Bhatt, Austin, TX (US)

(72) Inventor: Mayank Ashish Bhatt, Austin, TX (US)

(73) Assignee: Mayank Ashish Bhatt, Austin, TX (US)

( * ) Notice: Subject to any disclaimer, the term of this patent is extended or adjusted under 35 U.S.C. 154(b) by 550 days.

(21) Appl. No.: 13/952,432

(22) Filed: Jul. 26, 2013

Related U.S. Application Data

(60) Provisional application No. 61/677,957, filed on Jul. 31, 2012.

(51) Int. Cl.
*A61H 7/00* (2006.01)
*A61H 15/00* (2006.01)

(52) U.S. Cl.
CPC ..... *A61H 7/007* (2013.01); *A61H 15/00* (2013.01); *A61H 2015/0014* (2013.01)

(58) Field of Classification Search
CPC .... A61H 15/00; A61H 15/0078–15/02; A61H 2015/0007–2015/0071; A61H 2007/009; A61H 7/007
See application file for complete search history.

(56) References Cited

U.S. PATENT DOCUMENTS 3,389,699 A 6/1968 Mathers
3,419,268 A 12/1968 Bellet
3,622,152 A 11/1971 Place
4,134,584 A 1/1979 Rosenbusch
4,755,408 A 7/1988 Noel
4,945,900 A * 8/1990 Masuda ..... A61H 15/0092 601/120
5,143,056 A * 9/1992 Yih-Jong ..... A61H 15/00 601/118
5,411,470 A 5/1995 Liptak et al.
5,433,685 A 7/1995 Winslow et al.
5,488,755 A * 2/1996 Chang ..... A63B 23/16 16/430
5,529,550 A 6/1996 Maycock, Jr. et al.
5,573,485 A 11/1996 Geschwender
5,824,013 A 10/1998 Allen
6,231,489 B1 5/2001 McBride et al.
6,419,650 B1 * 7/2002 Ryan ..... A61H 15/00 601/122
6,449,788 B1 9/2002 Nichols
6,663,580 B1 12/2003 Adams
6,764,456 B1 7/2004 Doherty
(Continued)

*Primary Examiner* — Valerie L Woodward
(74) *Attorney, Agent, or Firm* — Sprinkle IP Law Group

(57) ABSTRACT

A system and methods are disclosed for manipulating soft tissue. In some embodiments, a roller has a cylindrical core with a plurality of protrusions disposed thereon, each protrusion having a height, durometer and radius of curvature and separated axially and circumferentially from nearby protrusions. Spacing between tow protrusions may allow protrusions to contact soft tissue while nearby bony tissue, nerves or wounds are avoided. End caps on the cylindrical core have a major diameter that may be less than, approximately the same as, or greater than the diameter of the cylindrical core and the height of the protrusions. A circumferential band may be devoid of protrusions.

20 Claims, 8 Drawing Sheets

(56) References Cited

U.S. PATENT DOCUMENTS 6,793,636 B1 9/2004 Pepera
7,137,926 B2 11/2006 Barrows
7,223,251 B1 * 5/2007 Cassidy
Phillips ..... A61H 15/0092 601/118
7,311,644 B2 12/2007 Hale
D567,952 S 4/2008 Fink
7,465,296 B2 12/2008 Chau
7,758,472 B2 7/2010 Stewart
7,779,495 B2 8/2010 Paranjpe et al.
7,918,774 B2 4/2011 Dye
2003/0010744 A1 * 1/2003 Ma ..... A61H 15/0092 215/382
2004/0204664 A1 * 10/2004 Chu ..... A61H 7/001 601/121
2005/0085749 A1 * 4/2005 Baerwalde ..... A61H 15/00 601/15
2006/0084893 A1 * 4/2006 Marten ..... A61H 15/0078 601/118
2006/0241537 A1 * 10/2006 Liu ..... A61H 15/0092 601/118
2008/0070210 A1 3/2008 Hitzmann
2008/0108484 A1 * 5/2008 Wu ..... A61H 15/0092 482/122
2008/0167168 A1 7/2008 Hurst
2009/0112137 A1 4/2009 Lamore
2009/0222994 A1 * 9/2009 Wood ..... A61H 15/0092 5/655.9
2009/0298651 A1 12/2009 Stewart
2009/0312691 A1 * 12/2009 Kim ..... A61H 15/0092 604/22
2010/0022924 A1 1/2010 Stieler
2010/0087761 A1 4/2010 Hitzmann
2011/0152035 A1 6/2011 Wahl
2012/0035029 A1 * 2/2012 Dye ..... A61H 15/0092 482/132
2012/0172771 A1 * 7/2012 Jian ..... A61H 15/0092 601/46
2013/0090582 A1 * 4/2013 Bertram ..... A61H 15/0092 601/119
2013/0096472 A1 * 4/2013 Bertram ..... A61H 15/0092 601/120
2013/0184620 A1 * 7/2013 Cohen ..... A61H 15/0092 601/118

* cited by examiner

DEVICES AND METHODS FOR MANIPULATING SOFT TISSUE

RELATED APPLICATION

This application claims the benefit of priority under 35 U.S.C. 119(e) to U.S. Provisional Patent Application No. 61/677,957, filed Jul. 31, 2012, entitled "DEVICES AND METHODS FOR MANIPULATING SOFT TISSUE," by Mayank Ashish Bhatt, which is fully incorporated by reference herein.

TECHNICAL FIELD

Embodiments disclosed herein relate generally to manipulating soft tissues within a body, and, in particular, to devices and methods for applying selected variations in pressure to strengthen, massage or rehabilitate soft tissue and improve joint function. Even more particularly, embodiments may be used to manage musculoskeletal conditions using self-massage and mobilization techniques for soft tissues as well as self-mobilization techniques for improved joint function.

BACKGROUND

Soft tissue injuries may be the result of a wide range of activities and successful recovery requires rehabilitation. Throughout this disclosure, various discussions of soft tissue injuries and rehabilitation are addressed as they are related to sports such as golf. Those skilled in the art will appreciate that this discussion is to assist in understanding features and techniques, but embodiments disclosed herein may be used to treat soft tissue injuries from other sports, work, or leisure activities.

As of 2004 there were more than 27.8 million golfers in the United States, including about 6 million avid golfers who play 25 rounds or more of golf per year. The average golfer typically plays 3-7 rounds of golf per year, and much more time is often spent on the practice range.

According to statistics from 1996, more than 36,400 people presented to the emergency room as a result of golf-related injuries, including injuries related to the swing itself.

A proper golf swing subjects a golfer to a large amount of torque, rotation, side bending and flexion. Due to compound movements involved in the golf swing, many injuries can occur to various body parts. Statistics from the Titleist Performance Institute identify the most common types of injuries among amateur golfers as sprain/strain; tendonitis; arthritis; disc injuries; and tears or fractures.

A study of golf-related injuries in the amateur population indicated the most common injuries were to the following regions and areas (in descending frequency): lower back, left elbow, left shoulder and left wrist. The most common cause of injuries among amateurs is a result of poor or aberrant mechanics. The most common cause of injuries to professional golfers is overuse. It is likely that 50% of touring professionals will sustain an injury that will prevent participation for 3 to 6 weeks. Additionally, about 50% of golfers (amateur or pro) will develop chronic problems particularly if they continue to reproduce aberrant biomechanics without addressing the musculoskeletal etiology.

Regardless of whether an injury was related to playing golf or some other mode, an injury to soft tissue affects the entire body. The spine is one part of the body which is susceptible to injuries. For example, the cervical spine is composed of 7 articulating vertebra that allow for 6 ranges of motion: extension, flexion, right and left rotation and right and left side bending. The cervical spine is also supported by a complex series of muscles and ligaments that help to support and stabilize the head neck. The cervical spine is a very mobile part of the spine, but unfortunately, with mobility often comes instability. The series of muscles that support the cervical spine are an integral part to providing stability. The cervical spine muscles in conjunction with the thoracic spine muscles provide postural integrity and support. Many times forward head posture leads to mechanical instability as the weight of the head causes loss of cervical spine lordosis. When the head is placed in a protracted position in which the ears are not in line with the shoulders and the chin juts forwardly, the weight of the head is placed in a biomechanical disadvantage: the anterior and posterior muscles of the cervical spine now require far greater amounts of stability which often cause them to guard against spasm. This in turn also adds strain and stress on the trapezius and levator scapula muscle groups, and subsequently into the shoulder rotators.

Inferior to the cervical portion of the spine, the thoracic portion is composed of 12 articulating vertebrae that are supported by the rib cage. The amount of torsion and rotation generated in the golf swing can be limited by the amount of thoracic range of motion. Many postural abnormalities such as hyper-kyphosis (i.e., an increase in the amount of curve in the mid back) will cause many golfers to set up their golf swing with what is commonly referred to as a C-posture. The C-posture is described as an excessive roundness in the upper back and can be caused by one or more of the following:

1) Limited thoracic spine extension;
2) Upper Crossed Syndrome—muscle imbalances including tight pecs, lats, upper traps, and levator scap and weakness in the mid-scapular muscles, serratus anterior, lower traps, and deep neck flexors;
3) Scapular instability; and
4) Instability in the core muscles causing poor posture and the slouched forward position at address.

Low back pain is the most common injury that affects the amateur and professional golfer. Some of the more common back injuries among golfers include sprain strain of muscles, SI joint and other soft tissues; facet syndrome; disc pathology; spinal stenosis; and degenerative joint/disc disease.

A recently published study in The Journal of Physical Therapy in 2005 found that there were several factors that were high predictors of lower back pain in golfers. They are as follows:

1) Body Mass Index—(BMI)—this is considered the strongest protector for low back pain in golfers. Golfers with a below average BMI (e.g., less than 25.7 kg/m2, which is typical in relatively tall, slender golfers) were more likely to experience low back pain that short heavy golfers;
2) Side Bridge Endurance Test—subjects in which left side bridge endurance time was greater than right side bridge endurance time by greater than 12.5 seconds reported more episodes of low back pain; and
3) Lead Hip Internal Rotation—professional golfers who experience low back pain in the previous 12 months also generally had reduced range of internal rotation of their lead hip.

Another area of the body that is susceptible to injuries, especially golf-related injuries, is the shoulder. The shoulder includes the rotator cuff, which is comprised of four muscles: supraspinatus, infraspinatus, subscapularis and teres minor. The shoulder joint is composed of three joints: the glenohumeral joint; the acromioclavicular joint; and the scapular thoracic region.

The majority of the population (golfers and non-golfers alike) present with shoulder external rotators that are significantly weaker than the internal rotators. This is a common trait of the slouched posture. The most common shoulder injuries related to golf include rotator cuff tendonitis, biceps tendinitis, impingement and labral tears.

Golfers that lack thoracic range of motion with extension and rotation are more prone to shoulder injuries bilaterally. As a result, the risk of a shoulder injury is more prominent in one shoulder than the other (e.g., the risk of injury to the left shoulder is higher than the risk of a shoulder injury to the right shoulder in a right-handed golfer).

The left shoulder is the lead shoulder in a right-handed golfer. The backswing requires the left shoulder to maneuver into horizontal adduction, pronation, and flexion during the "take away" phase of the golf swing. This position of the shoulder commonly causes impingement of certain rotator cuff muscles, which typically occurs when the glenohumeral head compresses the supraspinatus tendon in the subacromial space.

Another area of the body that is at risk for injury, particularly in golfers, is the hip. The hip muscles are commonly divided into four groups: the gluteal group (including gluteus maximus, gluteus medius, gluteus minimus and tensor fasciae latae); the lateral rotator group; the adductor group; and the iliopsoas group. In a right-handed golfer the left hip is considered the "lead" hip. The right hip is the trail hip and requires a full amount of internal rotation during the backswing.

Ranges of motion of the hip that are integral to the golfer allowing him or her to efficiently rotate the torso independently of the upper body primarily involve the hip internal and external rotators. The hip should have the ability to rotate 30 degrees internally and 40 degrees externally. When the golfer stands over the ball the hip is now "loaded"—this now requires full hip range of motion independent of trunk or torso range of motion. Many golfers demonstrate ranges of motion that are greater when tested in a seated or prone/supine position because many times the range of motion of the hip is recruited by using the spine or pelvis. When the hip is "loaded" it is now much more important for the range of motion of the hip to occur in the hip joint proper. When a golfer is unable to adequately rotate the right hip during the golf swing they often will "sway" on the backswing and likely "slide" on the downswing. The stability and flexibility of the gluteus medius muscle is paramount throughout the golf swing.

Another area of the body susceptible to injuries is the foot/ankle. Golf is played from the ground up, the only contact that a golfer has with the ground is the feet. The foot/ankle complex mobility is paramount to an effective and efficient golf swing. Foot and ankle mobility are determined by flexibility of the calf and anterior shin muscles (i.e., soleus, gastrocnemius and tibialis anterior). The tibialis anterior is located in the front of the lower leg, and tightness of this muscle will limit the ability to point the toes downward (or "plantarflex" the foot).

Treatment for injuries to any of the above mentioned areas, as well as other muscles or soft tissues, are generally include some form of ischemic pressure, movement-based muscle treatment, kneading, stretching (including static and active), and/or massage.

A common treatment for patients with strains and other injuries is to place two tennis balls in a sock and to tie each end of the sock keeping both balls in close proximity. In the case of soft tissue injuries near the spine, this practice includes positioning the balls along the spine (i.e., one ball on each side of the spinous process) and then applying pressure by lying on the balls (or pressing against the balls from a seated position as dictated by the patient's ability) to apply the appropriate amount of pressure. Variations generally include a golf ball, a lacrosse ball, a softball, etc., which are determined by the body region and amount of pressure generated to allow for therapeutic benefit.

Another common treatment is the use of foam rollers. Traditional foam rollers are formed with a solid surface which does not allow for the many contoured surfaces in the body. As such, in an attempt to contact a desired tissue, positioning a traditional foam roller might apply pressure to bony tissue.

Prior art approaches to enabling self-massage and self-manipulation rely on the ability of the patient to manipulate a generic smooth surface into contact with the desired tissue, the ability of the patient to select two balls having equal properties and position them into the proper configuration, and other variables. The varying resources, skill, and even range of motion of the patient could affect the amount of effort necessary to position a device on the desired tissue, resulting in a wide variance in the effectiveness of any device or prescribed therapy protocol.

SUMMARY OF THE DISCLOSURE

Many injuries (including golf-related injuries) can be avoided and the incidence of these injuries can be reduced by appropriately training the musculoskeletal system. By appropriately addressing the flexibility strength and pliability issues many injuries to the muscular skeletal system can be avoided and golfers as well as everyday people can participate in their chosen activities.

Embodiments disclosed herein have at least 3 observable and usable surfaces. The end caps are generally a smooth, continuous solid surface, allowing embodiments to roll on a floor, wall or other surface, as well as roll along a muscle such that pressure can be applied evenly along the muscle. A second surface includes distinctly designed elevations that are alternating or separated in their placement. This unique design allows for a more complete coverage with the body region being treated and also provides a kneading action. A third surface includes the middle portion which allows for clearance of body structures such as the spine, hip, scapula and many other bony protrusions that are potentially irritated by direct compression. The surface along the border of the central depressed area may have consecutive elevations versus alternating elevations which are located between the end-cap and the depressed central portion.

The size, height durometer, or radius of curvature of protrusions are selected such that deep muscle tissue is affected without a great deal of pressure applied (which may be contraindicated, painful, or otherwise undesirable) and embodiments allow for clearance of bony structures.

Embodiments of a therapeutic device and methods for using can help to address and treat many musculoskeletal disorders that prevent or impede normal function, including specific movements as they pertain to sports.

Embodiments disclosed herein can help to mobilize the thoracic spine and reduce the amount of kyphosis, such as by limiting the tightness in the erector spine muscles.

Embodiments disclosed herein can help with flexibility and pliability of the lumbar paraspinal muscles as well as the hip rotators and extensors. By allowing for greater range of motion and flexibility of these body regions there will be a significant reduction and decreased risk of hip and spine related problems.

Direct compression of osseous or bony protrusions can be damaging and painful. In some embodiments, a circumferential band, which may be an indented central portion (also referred to as a "bone safe zone"), allows the bony protrusions of the body to avoid or minimize contact with protrusions on the device. The bone safe zone may be aligned with the central part of the spine, with the knobby surfaces or protrusions of the device positioned on each of the paraspinal muscles. The amount of force can be manipulated by the user either applying greater or lesser body pressure, such as by manipulating the downward force of the body or simply by applying breathing techniques.

Embodiments disclosed herein may be effective in restoring normal thoracic spine range of motion and flexibility, therefore reducing the frequency of back related and shoulder related injuries. Embodiments can also be very effective in reducing tightness in the latissimus dorsi, which is a prominent internal rotator of the shoulder.

Embodiments disclosed herein can effectively address muscular guarding and tightness to various muscular regions in the neck, shoulder, arms, back, hips, legs and feet.

Embodiments disclosed herein can provide a tremendous increase in the amount of thoracic range of motion, vastly reducing the exposure to shoulder problems.

Embodiments disclosed herein can be used on the hip rotators to improve flexibility and pliability of the large hip movers, as well as the gluteal musculature.

Embodiments of the present invention are advantageous over prior art stabilization systems for manipulating soft tissues in the body. Multiple protrusions and "nobbies" that are placed at specific distances to each other and at certain angles to allow for the various contours in the human structure and anatomy. Embodiments may be manufactured with various distinct surfaces that can be used to treat or have other effects that prior art devices are unable to address. Furthermore, the various surfaces of embodiments disclosed herein may have a rounded contour to cover a larger surface area of tissue and allows for manipulation in an x and y plane while maintaining compression over selected acupressure points and trigger points.

Embodiments may be manufactured having protrusions in various durometers based on the amount of force needed as well as the acuteness of the tissue injury. The design of each of the protrusions may remain consistent, but the density of the material used to form cylindrical core, protrusions or end caps may vary.

Embodiments may be color coordinated based on a desired use. A set of devices may have varying durometers to accommodate different tissues, injuries, pain tolerances, weights, body types, flexibilities, ranges of motion, or other factors.

These and other aspects will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

A more complete understanding of the present invention and the advantages thereof may be acquired by referring to the following description, taken in conjunction with the accompanying drawings in which like reference numbers indicate like features and wherein.

DETAILED DISCLOSURE

Figure 1:
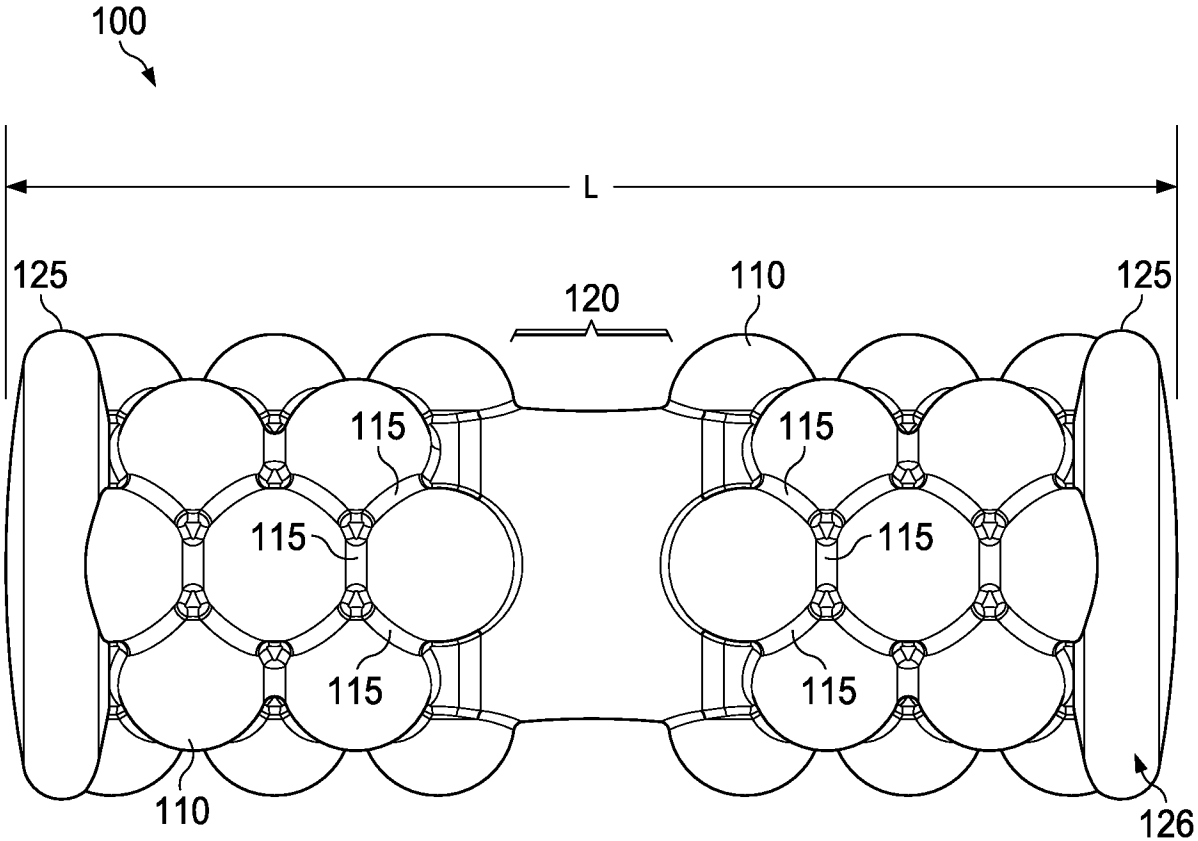
FIG. 1 depicts a side view of one embodiment of a device for manipulating soft tissue.
Figure 2:
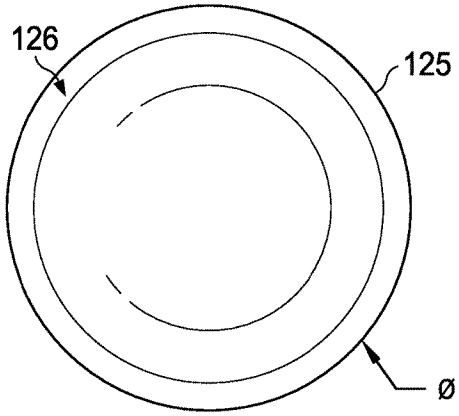
FIG. 2 depicts an end view of one embodiment of a device for manipulating soft tissue.
Figure 3:
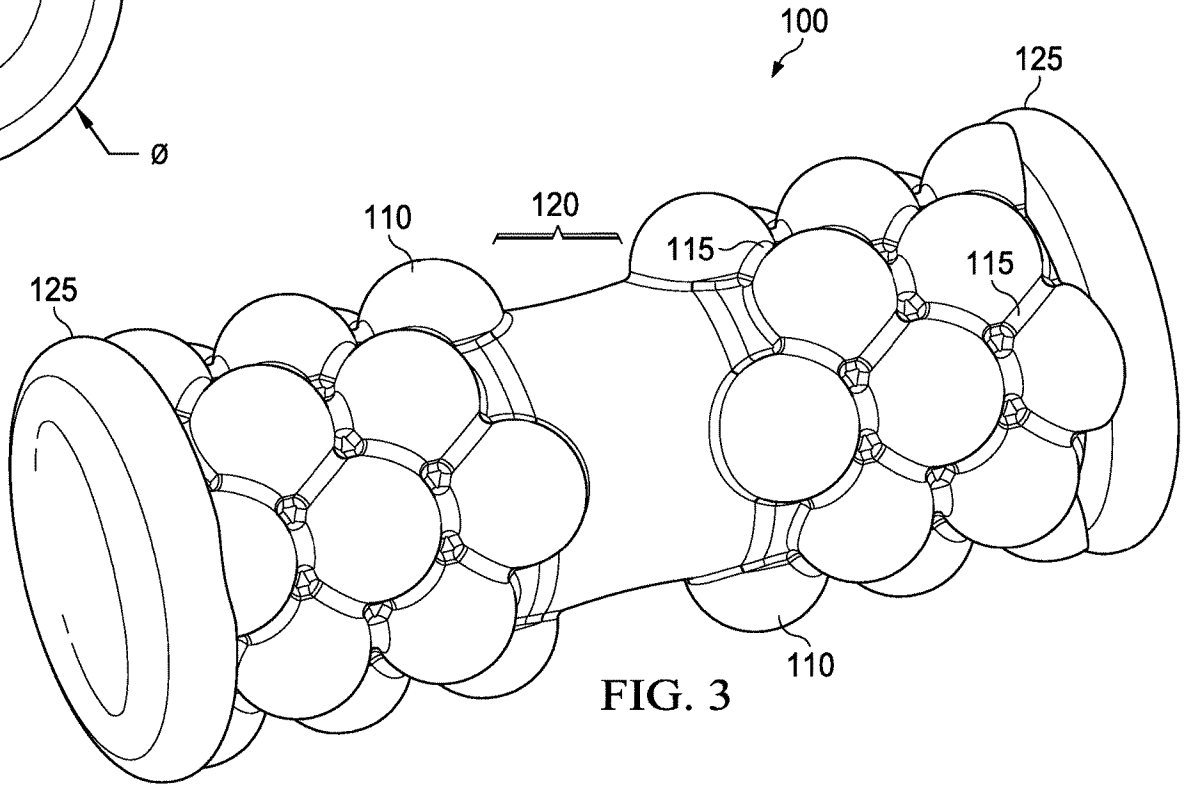
FIG. 3 depicts an isometric view of one embodiment of a device for manipulating soft tissue.
Figure 4B:
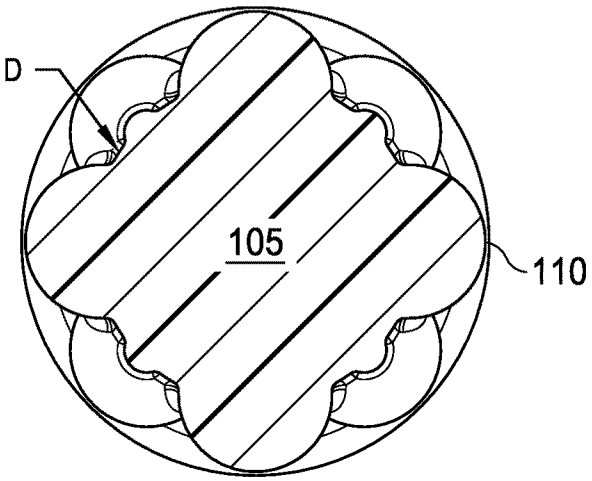
FIGS. 4A and 4B depict cross-sectional views of one embodiment of a device for manipulating soft tissue.
Figure 4A:
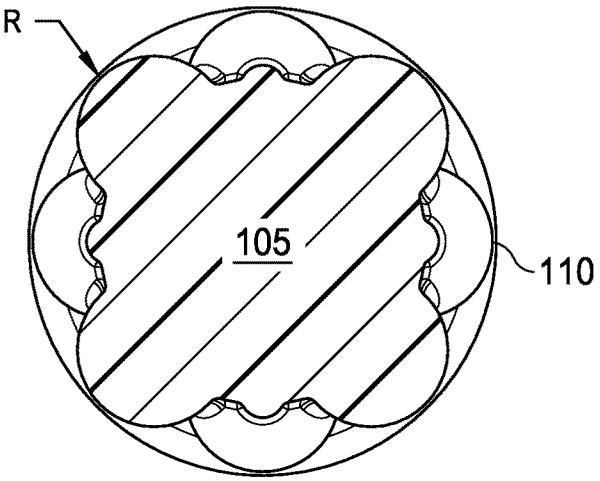

The invention and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure the invention in detail. Skilled artisans should understand, however, that the detailed description and the specific examples, while disclosing preferred embodiments of the invention, are given by way of illustration only and not by way of limitation. Various substitutions, modifications, additions or rearrangements within the scope of the underlying inventive concept(s) will become apparent to those skilled in the art after reading this disclosure.

Reference is now made in detail to the exemplary embodiments of the invention, examples of which are illustrated in the accompanying drawings. Wherever possible, the same reference numbers will be used throughout the drawings to refer to the same or like parts (elements).

The devices and systems described herein may be particularly useful for manipulating soft tissues to manage musculoskeletal conditions. For purposes of explanation, embodiments may be disclosed herein as they apply to the structures and soft tissues surrounding the spine (including the cervical and thoracic portions), the hip, the leg (including the quadriceps, the hamstring, the calf and shin), the foot/ankle or the shoulder. However, those skilled in the art will appreciate after reading this disclosure that embodiments disclosed herein may be useful using different techniques or on different portions of the body without departing in scope from the disclosure. Furthermore, embodiments disclosed herein may be used for strengthening exercises, improving flexibility of a muscle or muscle group, improving range of motion, or some other therapeutic purpose on an individual as desired the individual, as directed by a trainer, or under the guidance of a medical provider. Accordingly, the terms "user", "athlete" and "patient" may be used interchangeably herein. Furthermore, embodiments described herein may be used to manipulate soft tissue, such as by rolling, and the terms "roller" and "device" may be used interchangeably. Those skilled in the art will appreciate that embodiments may be used to apply static pressure as well as rolling pressure.

Embodiments may allow using self-massage and mobilization techniques for soft tissue injury rehabilitation as well as self-mobilization techniques for improved joint function.

Turning now to FIGS. 1-3, 4A-4B and 5-9, embodiments disclosed herein include roller 100 having cylindrical core 105 with a plurality of protrusions 110 extending radially outward therefrom. Protrusions 110 are spaced apart or otherwise separated in a selected configuration. Each protrusion 110 may be connected with nearby protrusions 110 via intermediate features 115. Embodiments also include end caps 125 located on ends of cylindrical core 105. In some embodiments, roller 100 may have a circumferential band 120 free of protrusions 110.

Roller 100 may be manufactured from one or more materials to provide selected characteristics. Materials may be selected to provide a desired hardness or durometer rating, elasticity, density, plasticity, etc. Materials may also be selected based on contact with a person, and have anti-bacterial or anti-mold properties, chemical resistance, crack- or tear-resistant properties, easy to clean surfaces, etc. For example, in some embodiments, a self-skinning polyurethane foam may be easy to injection mold, may provide a desired hardness or durometer rating, may resist cracking to minimize possibility of bacteria or other infectious organisms colonizing in the material, may provide an easy-to-clean surface for contact with perspiration, wounds or other sources of contamination from other users, may provide desired torsional stiffness, may be easier to grip, may result in a lighter weight roller, or some other manufacturing or use benefit. In some embodiments, material having a durometer of around 26 Shore A to around 50 Shore A may be used to manufacture roller 100. For example, a user may desire a hard roller 100 with a durometer between 42-50 Shore A, a firm roller 100 with a durometer between 32-42 Shore A, or a soft roller 100 with a durometer between 25-32 Shore A. In some embodiments, forming an outer layer (or "skin") of a desired thickness may provide roller 100 with a desired feel or texture. Those skilled in the art will appreciate that a chemical makeup for roller 100 may be selected from available compounds, such as flexible polyurethane (which may include flexible polyurethane foam and other variants). Examples of other materials that may be used for the construction of roller 100 include, but are not limited to, resins, cross-link foams, Ethylene-vinyl acetate (EVA) foams, low-density polyethylene (LDPE), and urethanes. Those skilled in the art will appreciate that material selection may be based on a desired density (e.g., between 8-20 pounds per cubic foot (pcf), stress (e.g., 50-60 kPa), etc. Furthermore, tool selection (such as using a plastic tool or mold vs. using an aluminum tool or mold), heat, and other manufacturing variables may be selected to provide additional desired characteristics of roller 100, such as the thickness of the outer surface, the durometer, the feel, etc.

In some embodiments, core 105, protrusions 110, intermediate features 115 and end caps 125 are formed as a single piece of uniform material. In other embodiments, portions of roller 100 are formed separately and joined to form a single piece. For example, cylindrical core 105 may be formed from a first material, protrusions 110 may be formed from a second material, end caps 125 may be formed from a third material. One or more of the materials may be selected to have a desired density, durometer, porosity, shear modulus, elastic modulus, biomedical application (e.g., bacteria-resistance, fungus-resistance), moisture resistance, heat/cold resistance, or other characteristic. In some embodiments, cylindrical core 105 may be formed from a material with a durometer of about 32 Shore A.

Cylindrical core 105 may be manufacture to have a desired bending or torsional stiffness. One or more of the bending stiffness and torsional stiffness may be the product of the material used to manufacture cylindrical core 105, the diameter D of cylindrical core 105, or the manufacturing process. In some embodiments, diameter D of cylindrical core 105 may be between 3 and 5 inches.

Embodiments disclosed herein may incorporate protrusions 110 extending from a solid foam core 105. As visible in FIGS. 4A and 4B, core 105 may have a diameter D, and protrusions 110 may have a radius R such that protrusions extend laterally out a distance approximately equal to ½ D+R. Protrusions 110 may include rounded surfaces of selected height and which are separated by some distance from nearby protrusions 110. Each protrusion 110 may have a selected height, radius of curvature and diameter. For example, in some embodiments protrusions 110 may have a uniform arc angle/arc length such that protrusions 110 are substantially hemispherical. In some embodiments, protrusions 110 may be formed having some arc angle/length less than hemispherical. In some embodiments, protrusions 110 extend about 1 inch from core 105, and the centers of protrusions 110 are separated by about 2.5 inches from nearby protrusions 110. Embodiments may also include intermediate or transitory features 115 between any two protrusions 110. Intermediate features 115 may provide transition surfaces such that the material used to manufacture roller 100 resists cracking, splitting or other material failure that could allow bacteria, fungus, or other undesirable organism to grow on or inside roller 100. Intermediate features 115 may also provide greater stability for protrusions 110, facilitate handling or gripping by a user, may contact tissue (but with less pressure) during use to provide additional therapeutic benefits, etc. In some embodiments, the size, shape or other characteristic of protrusions 110 or intermediate features 115 may allow roller 100 to have a durometer of between about 25 Shore A and about 50 Shore A, but without applying pressure to bones, nerves, wound sites, or other areas in which pressure is contraindicated or undesirable.

As seen in the figures, axial spacing between nearby protrusions 110 may differ from circumferential spacing. In either case, the spacing or separation between two protrusions 110 may depend on the height, width or radius of curvature of one or more protrusions 110, the diameter of cylindrical core 105, or the like. Spacing or separation between any two protrusions 110 may also depend on the material used to manufacture roller 100, the hardness or durometer of core 105 or protrusions 110, the elasticity of protrusions 110, and the like. Variations between axial separation (i.e., along the length of roller 100) and circumferential separation (i.e., around roller 100) may allow a user to contact more protrusions 110 relative to a lateral/medial orientation and fewer protrusions relative to a proximal/distal orientation, or vice versa during a particular exercise or treatment.

Figure 5:
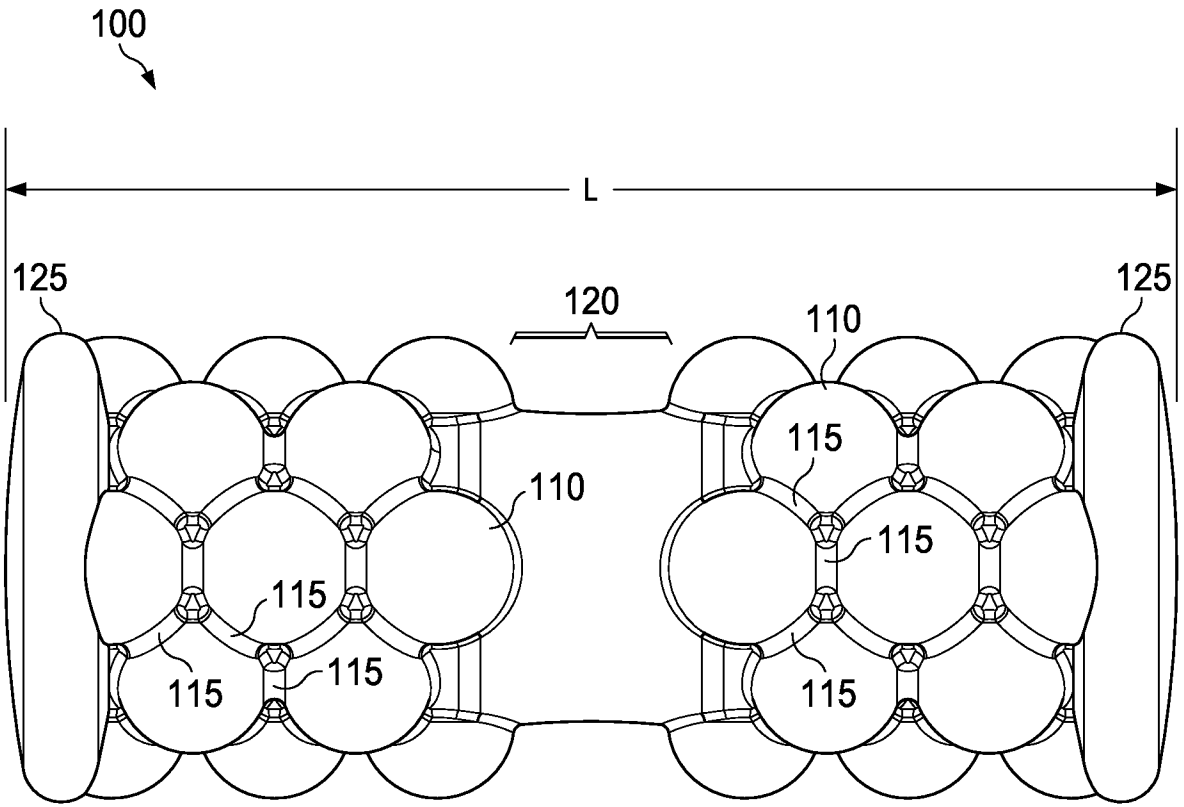
FIG. 5 depicts a side view of one embodiment of a device for manipulating soft tissue.
Figure 6:
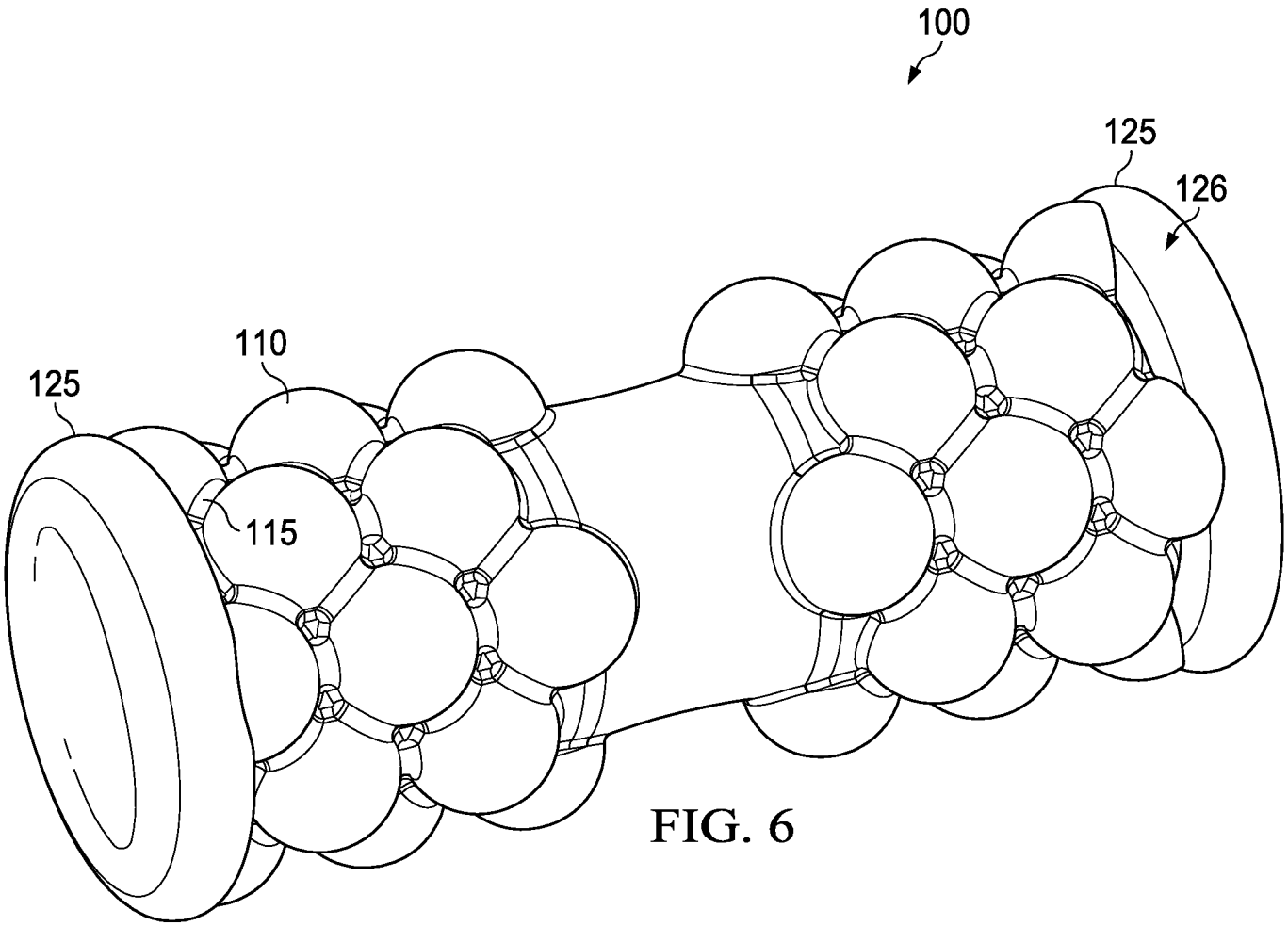
FIG. 6 depicts an isometric view of one embodiment of a device for manipulating soft tissue.
Figure 7:
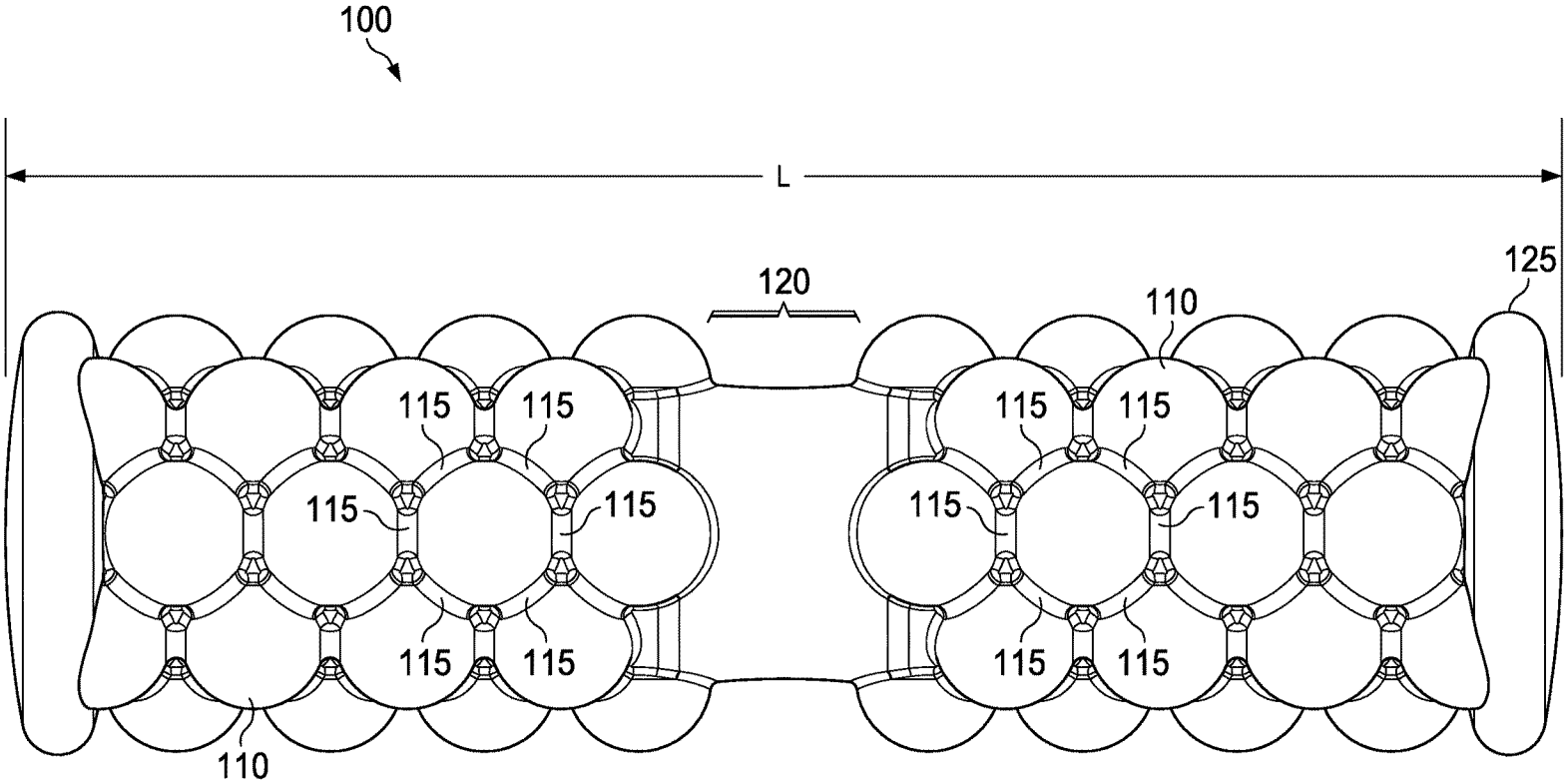
FIG. 7 depicts a side view of one embodiment of a device for manipulating soft tissue.
Figure 8:
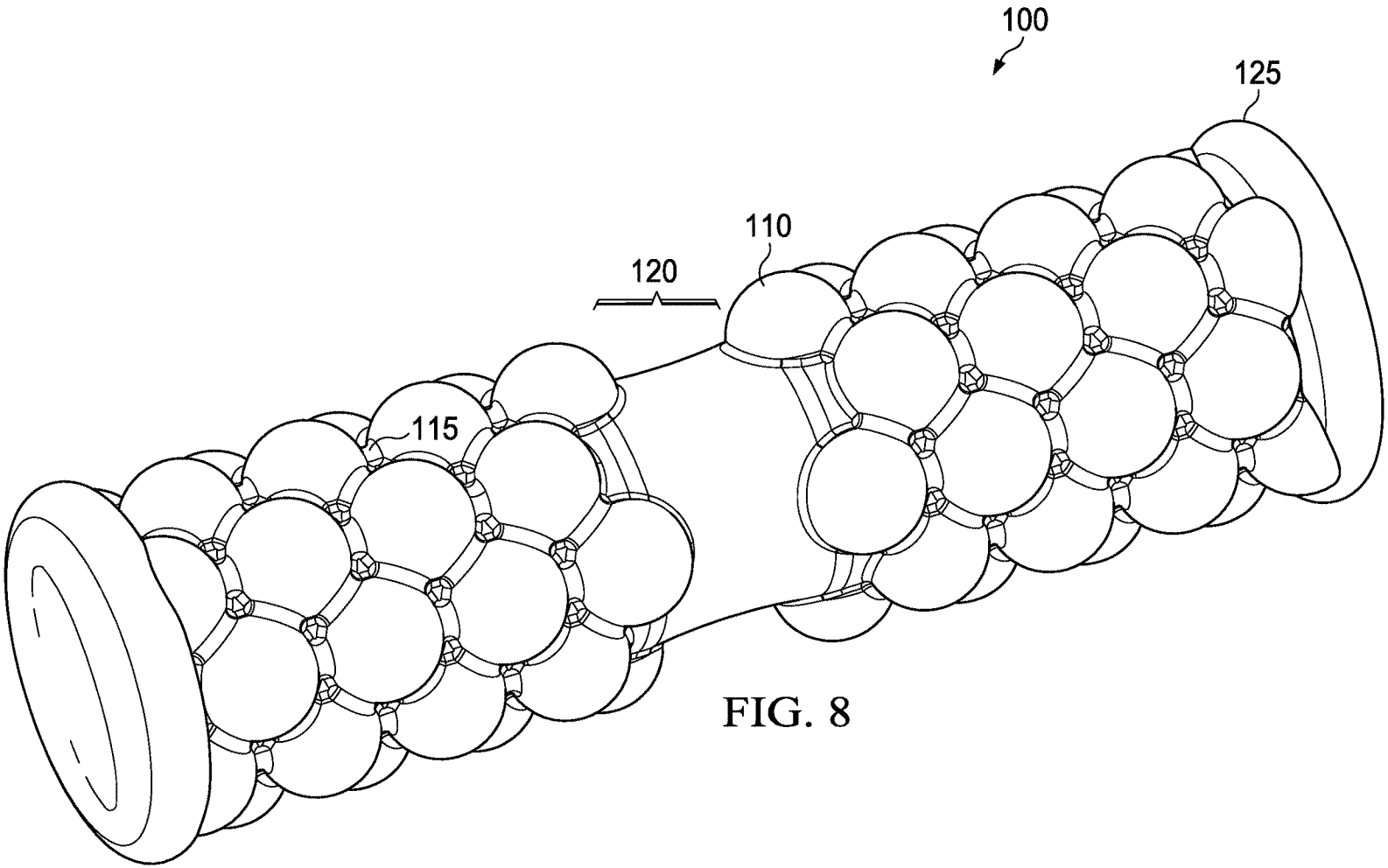
FIG. 8 depicts an isometric view of one embodiment of a device for manipulating soft tissue.

The overall dimensions of a device may be important for transportation, use, and the like. For example, a golfer may like a device small enough to be carried in a golf cart, a professional athlete may want a device that can be taken on board a plane, etc. Dimensions may also depend on the size of the user or the size of a body part that the user wants to treat. For example, an average size patient may have a torso width between 18-24 inches. Dimensions may also depend on other factors of use. For example, during use, a patient may have limited flexibility or range of motion. To accommodate one or more factors, roller 100 may be manufactured having a length L to enable a user to perform self-massage techniques without struggling to manipulate a large device. For example, roller 100 as depicted in FIG. 1 may have length L between 12 inches and 15 inches in length. As depicted in FIG. 5, roller 100 may have length L between 15 inches and 20 inches in length. As depicted in FIG. 7, roller 100 may have length L between 20 inches and 25 inches in length. In some situations, a smaller device may be more advantageous, such as for people who travel by airplane and need a device to fit in small storage areas or has minimal weight. Embodiments of roller 100 may include a shorter version, such that the length of roller 100 is less than 15 inches, less than 12 inches, or less than 10 inches. Other dimensions may remain the same, and a user may maintain most of the functionality of roller 100 having a larger overall length while still having a more portable device. FIGS. 1 and 5 depict one embodiment of roller 100 having length L that is shorter than length L of roller 100 depicted in FIG. 7, but which still may provide a desired therapeutic benefit to a user.

Roller 100 may include other features for improving the therapy of a muscle or joint. In some embodiments, end caps 125 of roller 100 have a solid or rigid continuous surface which allows for improved rolling ability and provides greater stability in order to allow for full body weight compression forces. End caps 125 may further allow a user to apply relatively constant pressure along the entire length of a desired muscle, throughout an exercise or treatment. For example, end caps 125 may be used to apply pressure continuously along the entire length of a biceps femoris, rectus femoris, soleus or similar leg muscle.

Figure 9:
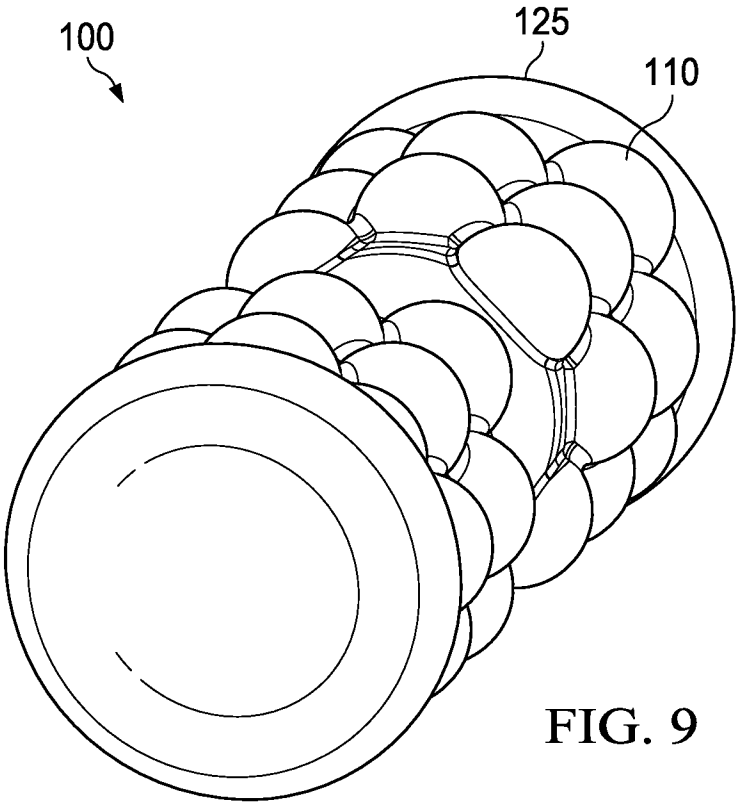
FIG. 9 depicts an isometric view of one embodiment of a device for manipulating soft tissue.

End caps 125 may have a surface or shape which is advantageous for therapeutic compression. Surface 126 of end cap 125 may be substantially flat (i.e., perpendicular to the longitudinal axis of roller 100), or may be radiused or beveled. For example, surface 126 of end cap 125 may have a radius or curvature of 15 inches. In some embodiments, end cap 125 may have a curved or radiused profile. For example, FIGS. 1-3, 5, 7 and 9 depict views of embodiments of roller 100 showing end caps 125 having a minor diameter of about 1 inch. The selection of a particular minor diameter or bevel angle may be based on a set of factors including, but not limited to, providing a better gripping feature, providing a desired pressure or reduced (or increased) rolling resistance. The shape, including any radius or curvature, of end cap 125 may allow for ease of handling, and may also provide an additional surface for treatment of tissue. In some embodiments, end cap 125 may extend radially outward from a longitudinal axis of roller 100 and have a corresponding radius of about 0.5 inches. In some embodiments, the major diameter of end cap 125 is greater than the outer diameter of protrusions 110. FIG. 9 depicts an isometric view of one embodiment of roller 100 having end caps 125 which have a major diameter that exceeds the outer diameter or dimension of protrusions 110. In some embodiments, the curvature or thickness of end cap 125 may be less than the diameter of protrusions 110 to allow more pressure to be applied to soft tissue via protrusions 110. For example, protrusions 110 may extend about one inch from cylindrical core 105, and end caps 125 may extend only about ¾ inch (0.75 inches) or less.

Embodiments may include circumferential band 120, comprising a region free or devoid of protrusions 110. Circumferential band 120 may be located near the midline of cylindrical core 105. In some embodiments, circumferential band 120 has a relief portion or concave surface or is otherwise depressed. The width of circumferential band 120 or the depth to which circumferential band 120 is depressed may be selected to accommodate bony tissues, such as to allow for paraspinal treatment, to avoid an injury site, to avoid pressure on nerves, to allow a user to grip the roller or the like. In some embodiments, the width of circumferential band 120 of roller 100 may be selected to provide clearance for the spinous processes. In some embodiments, a minimum distance of about two inches between protrusions located on either side of circumferential band 120 provides enough room for protrusions 110 to avoid the bony protrusions of the cervical spine and will efface the paraspinal muscles. Embodiments having circumferential band 120 provide unique advantages over prior art approaches in that roller 100 may be used to apply substantially even pressure on either side of a wound, spine or bony tissue, or nerve without contacting the wound, spine or bony tissue or nerve. Circumferential band 120 may be depressed to accommodate bony tissue, nerves or the like. In some embodiments, circumferential band 120 having a relief between 0.1-0.25 inches may provide more clearance for bony tissue.

In some embodiments, protrusions 110 allow for compression of soft tissue and joints that are not adequately reached or treated with conventional solid rollers. Protrusions 110 and end caps 125 of roller 100 provide surfaces that allow for treatment of body regions that require a non-solid surface. For example the paraspinal muscles are at a higher surface than the spinous process. In order for compression of the paraspinal muscles without direct compression of the spinous process, embodiments may have a contoured surface. The contoured surface allows for treatment of the muscles without directly compressing the bony aspect of the spine. In some embodiments, the surface on each side of central band 120 provides a continuous non-alternating surface which may be used over body regions with prominent bony protrusions surrounded by muscle groups. Embodiments of roller 100 can also be used for other body regions where bony protrusions are evident such as the greater trochanter of the femur. The hip girdle musculature is another example of how the multiple contours of roller 100 provide a superior treatment for soft tissue injuries. Many of the gluteal muscles and hip rotator muscles insert into the proximal portion of the femur. In order to not compress the greater trochanter of the hip, the spacing or separation between protrusions 110 of roller 100 allows for soft tissue compression of the gluteal muscles without directly pushing on the surrounding bony tissue, therefore avoiding potential deep bruising of the bony surface. Another example is the iliotibial band (also known as the IT band or ITB) which originates in the hip/pelvis and inserts at the knee. In one embodiment, roller 100 may have an overall length of approximately 15, 18 or 21 inches, cylindrical core having a diameter of approximately 4.25 inches, protrusions 110 having a radius of approximately 1 inch, end caps 125 having a major diameter of approximately 6 inches and a minor diameter of approximately 1 inch, spacing between adjacent protrusions 110 of approximately 2.5 inches, circumferential band 120 of approximately 2 inches and a diameter of approximately 3.9 inches (or a relief of approximately ¼ inch) and a durometer of between 25-50 Shore A. Other dimensions and durometers are possible.

Advantageously, embodiments disclosed herein will allow for compression of the musculature that insert in the region of the greater trochanter without directly compressing the bony protrusion.

Embodiments disclosed herein may also be used to perform specific processes in a strengthening, flexion or rehabilitation process. For example, a patient may be directed to use protrusions 110, end caps 125 or central band 120, or some combination thereof to achieve a desired goal, or a user may select roller 100 having a desired durometer, texture, or other characteristic for a desired effect.

Common injuries can be addressed using roller 100 are addressed herein in order to begin the process by which to teach and train users of roller 100 in an expanding fashion. In addition to discussing these injuries the process will include specifically prescribed exercises to strengthen these body regions in turn reducing the number of acute and recurrent golf injuries. Roller 100 may be an integral part of an entire golf or other sport rehabilitation program that extends beyond tissue pliability and flexibility and expands into a strengthening and stability system. Use of specific strengthening exercises performed with resistance bands, resistance loops, weighed and non-weighted balls are described herein. Features of roller 100 allow for pressure and compression coupled with movement as utilized in techniques such as Active Release Therapy (ART) and myofascial release. The human body has many contours that are not reachable or addressed with solid surface rollers. An advantage of roller 100 may be the height, radius of curvature or width, durometer and separation between protrusions gives a user the ability to apply pressure to specific trigger points or acupressure points while avoiding contact with surrounding bony tissues, nerves, organs, etc., by using the alternating or consecutive nature of the various contours. In some embodiments, end cap 125 allows for continuous pressure as needed.

Embodiments of roller 100 may be used to stretch, strengthen or otherwise manipulate hip flexors, which are typically weak. For example, a user can position himself/herself in a prone position (i.e., stomach down) on roller 100 with roller 100 positioned with elevated surfaces starting at the front of the pelvis or ASIS. Pressure may be applied in varying amounts which can be increased or decreased. (For example, pressure may be applied as if applying pressure to an egg on its end trying not to crack the egg.) Pressure may be varied according to an exercise routine, rehabilitation program or treatment protocol. Roller 100 may be positioned such that a maximum number of protrusions 110 are in contact with tissue associated with the ASIS and rolled in distally/proximally (i.e., an upwards and downward fashion) to extend protrusions 110 further into the quadriceps which can also aid with the hip flexors as the rectus femoris muscle crosses both the hip and knee. Pressure may also be varied by using a different durometer roller 100. A way to increase the stretch of the hip flexor during rolling would be to extend the spine or hip by arching backwards or pulling the heel closer to the buttocks and extending the hip. Variations in durometer, spacing between protrusions 110, positioning of central band 120, etc., may be selected to allow a user to apply a milder amount of pressure in this region as many arteries, veins and nerves are housed in this region of the body and are more exposed. A typical program may include multiple repetitions of these steps.

The hip abductors and rotators are essential for a good solid golf swing. The gluteal muscles and hip rotators allow for necessary rotation of the hip throughout the swing strength and flexibility for these body regions is imperative and will reduce the sway on the takeaway. Roller 100 is very effective to produce ischemic compression and pressure point massage/acupressure. This region of the body can tolerate more pressure than the hip flexors. Treatment may begin by the user laying an affected side on roller 100 with protrusions 110 positioned near the body landmark (e.g., the iliac crest).

Use 2-3 of the elevated surfaces and place them on the gluteal musculature apply much firmer pressure equal to or pressing a tennis ball into the concrete with a bare foot. Increase pressure as tolerated. Rotation forward or backwards over roller 100 may generate forces in an x and a y axis. Additional pressure can be placed in a downward fashion extending into the iliotibial band and posteriorly into the hamstring. Roller 100 can also be placed in a lengthwise direction and lateral pressure can be applied. A typical program may include multiple repetitions of these steps and may be sufficient to loosen connective tissue, increase circulation in the area, and provide other benefits.

The lower leg and calf region are also integral to the golf swing. Everything stable has a good foundation. The foundation of the golf swing starts from the ground up, there is footwork involved in the golf swing. If the gastrocnemius/soleus complex is not flexible or limber many injuries can be at risk. Embodiments disclosed herein may allow a user to position the roller such that the protrusions and end cap do not contact bony tissues, nerves, injury sites and the like. Roller 100 may be positioned or oriented to allow roller 100 to be rolled along a length of the leg, sideways, or at some angle relative to the muscle.

Common foot and ankle injuries in golfers include plantar fasciitis and Achilles tendonitis. Roller 100 can be used by standing on the roller and working in a forward/backwards fashion. A softer durometer may be used for initial treatments and firmer durometers may be used for subsequent treatments, the foot may be positioned to contact a selected protrusion 110, circumferential band 120, end cap 125, etc.

The lumbar spine is commonly injured in the golfer, and generally speaking, lower back pain is the second leading cause of visits to the family physician. Golf dramatically increases rotational and shearing forces on the spine that often leads to pathology that can result in pain and dysfunction. Roller 100 can be used for spinal flexibility and has specific engineering alterations that deal with spine specific issues. Circumferential band 120 of roller 100 may provide a gap of around 2 cm or more to limit exposure to the spinous processes in the back. Vertebrae in the spine do not fare well to direct compressive force. In some embodiments, circumferential band 120 of roller 100 has a depressed center portion allowing for compression and kneading of the paraspinal muscles by protrusions 110 without protrusions 110 contacting the vertebrae.

In addition to rolling in an up and downwards fashion, roller 100 also aids in lumbar extension mobilization. Use of roller 100 for the lumbar spine may involve the user laying backwards on the roller starting over the upper buttocks and lower spine. Using legs and arms, the user can apply greater or lesser pressure as they roll in an upward and downward fashion. Treatment may begin with light pressure. For example, embodiments may be positioned on a wall and the user may lean against roller 100 to apply a desired pressure that is less than his/her body weight. Advantageously, embodiments disclosed herein may be manufactured from materials that are non-marking or otherwise avoid damage to walls. Roller 100 can also be placed in a lengthwise fashion, with the user being careful to avoid the spine contacting end cap 125 or protrusions 110. A typical program may include multiple repetitions of these steps.

The amount of rotation and side bending in the golf swing is also highly dependent on thoracic spine mobility and flexibility as well as strength of the mid back. The golf takeaway is highly dependent on the ability to rotate the torso independent of the lower body. If the mid-back is stiff or restricted then many golf swing faults can occur. Roller 100 can be applied to the thoracic spine or mid-back to increase spine mobility. The user may position roller 100 on a wall such that the amount of pressure may be reduced by 50% (or less) of pressure applied to the lumbar spine. The amount of pressure can also be increased or decreased accordingly by applying upward or downward pressure. Embodiments disclosed herein may provide necessary contact with soft tissue, while avoiding bony tissue, nerves, blood vessels and the like, and while supporting the body.

Three thumb-position pulls and rows may be utilized to include thumbs up, out and in. Wide grip pull downs also strengthen the latissimus dorsi which is a secondary stabilizer of the lumbar spine. Bands or other resistance equipment may be utilized to strengthen the scapular retractor muscles which are crucial for posture.

Posture is inherently lost during day to day tasks such as sitting at a desk, driving or sitting with a laptop. Posture is also a very important part of the golf setup. Those with particularly poor posture will tend to set up to the golf ball with a C-Curve or C-posture. The C-Curve or C-posture generally leads to swing faults and injuries. Poor posture is also a primary cause of the trapezius muscle being weak in the majority of the population. Sitting posture is the leading reason, as the head often protrudes forward causing the thoracic spine to flex leading to a kyphotic deformity. Roller 100 can be applied to the entire scope of the trapezius and thoracic spine. Protrusions 110 on roller 100 have the unique ability to mold to the tissues in the various contours in the human body. A traditional solid foam roller is generally unable to address a large portion of the muscles being treated. The undulations and protrusions in roller 100 will cover a more complete portion of the muscle.

The latissimus dorsi is also a vital part of the golf swing. The latissimus dorsi is often a very tight and weak muscle just as the trapezius is tight and weak for the same reason which is posture. A part of the action of the latissimus dorsi is to perform internal rotation of the shoulder as well as to perform extension and adduction of the arm. Each of these are integral components of the golf swing as the trail arm requires a great amount of adduction as the arm crosses the upper body during the downswing and follow through.

One process by which to perform release of the latissimus dorsi may be to place the arm in an overhead position while in a side lying position start with the roller either at the proximal ⅓ of the humerus or at the lowest portion of the thoracic spine. If starting at the humeral end of the latissimus dorsi, the user may use their lower body as well as the elbow of the elevated arm to move the body in an upwards or cephalic position. Starting at the lowest portion of the muscle, the user may simply let the weight of their body slowly drop towards the ground forcing the upper body into a downwards or caudal direction.

An advantage of roller 100 that traditional foam rollers are not able to address is that the user may use one of three different surfaces for all muscular or musculoskeletal body regions being treated. For example, for self-directed treatment of the latissimus dorsi, the user could use the central depressed portion of roller 100 and the central groove will help accommodate the lateral edge of the scapula. If the latissimus dorsi has enough muscle girth that would limit the exposure of roller 100 with osseous surfaces to include the ribs and lateral border of the scapula, then the outside solid portion of roller 100 or the surface between the outside edge and central portion of roller 100 could be used.

Compression of body regions being treated can be altered or managed by various methodologies. One way may involve different densities of roller 100. Embodiments may be color coordinated to correspond with various degrees of stiffness, hardness or other characteristic.

Other uses of rollers 100 may be possible. Those skilled in the art will appreciate that these descriptions are exemplary and not to be construed as limiting the use of rollers 100 to any particular part of the body. Furthermore, these descriptions are exemplary in that there may be more than one approach to treating a part of the body using rollers 100. For example, a rehabilitation treatment may use a first durometer roller 100 in conjunction with a rehabilitation program, and a strengthening routine may use a second durometer roller 100 in conjunction with a strengthening program. In some embodiments, roller 100 may be referred to as Swingbak or a Swingbak roller. Those skilled in the art will appreciate that these terms may refer to selected embodiments or for use with selected treatments or routines, and should not be construed as limiting the disclosure.

In the foregoing specification, the invention has been described with reference to specific embodiments. However, one of ordinary skill in the art appreciates that various modifications and changes can be made without departing from the scope of the invention as set forth in the claims below. For example, embodiments may include protrusions 110, end caps 125 and circumferential band 120, or may be formed with only circumferential band 120 and end caps 125, protrusions 110 and circumferential band 120, end caps 125 and protrusions 110, etc. Accordingly, the specification and figures are to be regarded in an illustrative rather than a restrictive sense, and all such modifications are intended to be included within the scope of invention.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component of any or all the claims.

What is claimed is:

1. A system for manipulating soft tissue, comprising:

a solid roller formed of a single piece of uniform material, including:

a solid cylindrical core having a first durometer having a plurality of uniform hemispherical protrusions disposed on a first portion and a second portion of the cylindrical core, each protrusion having the first durometer, height and radius of curvature selected for applying pressure to soft tissue without substantial deflection of the protrusion, the protrusions on the first and second portions separated from other protrusions by a first distance axially and by a second distance circumferentially, the first portion having an effective outer diameter defined by a diameter of the cylindrical core and the height of the protrusions and disposed at a first end of the cylindrical core, and the second portion having the effective outer diameter defined by the diameter of the cylindrical core and the height of the protrusions and disposed at a second end of the cylindrical core;

a plurality of intermediate features, each intermediate feature providing a raised transition surface between at least two protrusions;

a first end cap formed at an end of the first portion distal from a centerline of the cylindrical core, the first end cap having a major diameter equal or greater than the effective outer diameter of the first portion;

a second end cap formed at an end of the second portion distal from the centerline of the cylindrical core, the second end cap having the major diameter equal or greater than the effective outer diameter of the second portion; and a circumferential band on the cylindrical core, free of protrusions and separating the first portion and the second portion by a third distance greater than the first distance separating the plurality of protrusions axially, the circumferential band further comprising a relief area having a diameter less than the diameter of the cylinder core.

2. The system of claim 1, wherein the diameter of each end cap corresponds to a perimeter substantially equal to a length of one of a semitendinosus, semimembranosus, biceps femoris, or tibialis anterior muscle, whereby each end cap is capable of applying continuous pressure substantially along the length of one of the semitendinosus muscle, the semimembranosus muscle, the biceps femoris muscle, or the tibialis anterior muscle.

3. The system of claim 1, the durometer and radius of curvature being selected for acupressure of one of a trapezius, rectus femoris, or gluteal muscles, wherein the separation between two adjacent protrusions being selected to avoid contact with bony tissue when a protrusion is in contact with one of the trapezius, rectus femoris, or gluteal muscles.

4. The system of claim 1, wherein each end cap is radiused.

5. The system of claim 1, wherein the width of the circumferential band is greater than two inches.

6. The system of claim 1, wherein the relief area has a depth of about ¼ inch relative to the cylindrical core.

7. The system of claim 1, wherein each end cap has a second durometer.

8. The system of claim 7, wherein the first durometer and the second durometer are the same.

9. The system of claim 8, wherein the cylindrical core, the end caps and the plurality of protrusions are formed from the same material.

10. The system of claim 7, wherein the first durometer is between 42-50 Shore A, between 32-42 Shore A or between 25-32 Shore A.

11. The system of claim 1, wherein each intermediate feature provides the raised transition surface between at least two adjacent protrusions and contacts each of the at least two adjacent protrusions.

12. A method of manufacturing a system for manipulating soft tissue, comprising:

forming a solid roller of a single piece of uniform material, including:

forming, on a solid cylindrical core having a first durometer, a plurality of uniform hemispherical protrusions disposed on a first portion and a second portion of the cylindrical core, each protrusion having the first durometer, height and radius of curvature selected for applying pressure to soft tissue without substantial deflection of the protrusion, the protrusions on the first and second portions separated from other protrusions by a first distance axially and by a second distance circumferentially, the first portion having an effective outer diameter defined by a diameter of the cylindrical core and the height of the protrusions and disposed at a first end of the cylindrical core, and the second portion having the effective outer diameter defined by the diameter of the cylindrical core and the height of the protrusions and disposed at a second end of the cylindrical core;

forming a plurality of intermediate features, each intermediate feature providing a raised transition surface between at least two protrusions;

forming a first end cap at an end of the first portion distal from a centerline of the cylindrical core, the first end cap having a major diameter equal or greater than the effective outer diameter of the first portion; and forming a second end cap at an end of the second portion distal from the centerline of the cylindrical core, the second end cap having the major diameter equal or greater than the effective outer diameter of the second portion, wherein a circumferential band is formed on the cylindrical core, free of protrusions and separating the first portion and the second portion by a third distance greater than the first distance separating the plurality of protrusions axially, the circumferential band further comprising a relief area having a diameter less than the diameter of the cylinder core.

13. The method of claim 12, wherein each end cap has a second durometer.

14. The method of claim 13, wherein the first durometer and the second durometer are the same.

15. The method of claim 14, wherein the cylindrical core, the end caps and the plurality of protrusions are formed from the same material.

16. The method of claim 15, wherein the material is polyurethane foam, cross-link foam, Ethylene-vinyl acetate foam or urethane.

17. The method of claim 14, wherein the first durometer is between 42-50 Shore A, between 32-42 Shore A or between 25-32 Shore A.

18. The method of claim 12, wherein the relief area has a depth of about ¼ inch relative to a diameter of the cylindrical core.

19. The method of claim 12, wherein the cylindrical core has a length less than about 15 inches.

20. The method of claim 12, wherein each intermediate feature provides the raised transition surface between at least two adjacent protrusions and contacts each of the at least two adjacent protrusions.

* * * * *